US009087664B2

(12) United States Patent
Liu

(10) Patent No.: US 9,087,664 B2
(45) Date of Patent: Jul. 21, 2015

(54) CIRCUIT BREAKER WITH COMPACTABLE CONTACT STRUCTURE

(71) Applicant: LSIS CO., LTD., Anyang-si, Gyeonggi-do (KR)

(72) Inventor: Chenxin Liu, Beijing (CN)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/292,486

(22) Filed: May 30, 2014

(65) Prior Publication Data

US 2015/0069018 A1 Mar. 12, 2015

(30) Foreign Application Priority Data

Sep. 11, 2013 (KR) ..... 10-2013-0109331

(51) Int. Cl.

*H01H 33/70* (2006.01)
*H01H 33/88* (2006.01)
*H01H 33/66* (2006.01)

(52) U.S. Cl.

CPC ..... *H01H 33/88* (2013.01); *H01H 33/7015* (2013.01); *H01H 33/7038* (2013.01); *H01H 33/66* (2013.01); *H01H 33/7076* (2013.01)

(58) Field of Classification Search

CPC ..... H01H 33/66; H01H 33/70; H01H 33/88
USPC ..... 218/43, 50, 51, 53, 59, 62, 72
See application file for complete search history.

(56) References Cited

U.S. PATENT DOCUMENTS

| | | | | |
|---|---|---|---|---|
| 4,289,942 | A * | 9/1981 | Milianowicz | 218/62 |
| 4,383,152 | A * | 5/1983 | Koppl et al. | 218/51 |
| 2003/0173334 | A1 * | 9/2003 | Kida et al. | 218/43 |
| 2007/0262053 | A1 * | 11/2007 | Yoshitomo et al. | 218/59 |

FOREIGN PATENT DOCUMENTS

| | | |
|---|---|---|
| DE | 1202379 | 10/1965 |
| JP | 2002-025400 | 1/2002 |
| JP | 2007-073384 | 3/2007 |

OTHER PUBLICATIONS

European Patent Office Application Serial No. 14175512.4, Search Report dated Jan. 27, 2015, 4 pages.

* cited by examiner

*Primary Examiner* — Truc Nguyen
*Assistant Examiner* — Bunyamin Tufan
(74) *Attorney, Agent, or Firm* — Lee, Hong, Degerman, Kang & Waimey

(57) ABSTRACT

The present disclosure relates to a circuit breaker having a compact contact assembly structure, including a stationary portion; and a movable portion to be contact with or to be separated from the stationary portion, wherein the movable portion includes a puffer cylinder configured to temporarily store a compressible fluid; a moving main contact assembled to an end of the puffer cylinder; and a moving nozzle inserted into the moving main contact, and the moving main contact includes an internal protrusion protruded in a radial direction and separated in a circumferential direction from an inner surface thereof, and the moving nozzle includes an external protrusion protruded in a radial direction and separated in a circumferential direction on an external surface thereof, and the internal and external protrusions are alternately coupled to the puffer cylinder, respectively, by a fastening member along the circumferential direction.

6 Claims, 7 Drawing Sheets

CIRCUIT BREAKER WITH COMPACTABLE CONTACT STRUCTURE

CROSS-REFERENCE TO RELATED APPLICATIONS

Pursuant to 35 U.S.C. §119(a), this application claims the benefit of earlier filing date and right of priority to Korean Patent Application No. 10-2013-0109331, filed on Sep. 11, 2013, the contents of which are all hereby incorporated by reference herein in its entirety.

BACKGROUND OF THE INVENTION

1. Field of the Invention

The present disclosure relates to a circuit breaker for extinguishing an arc with compressed insulating gas when a fault current occurs in a power system to block the fault current.

2. Description of the Related Art

Gas Insulator Switchgear (GIS) may switch a load current under a normal use condition for a power system.

Furthermore, the gas insulator switchgear is a device capable of safely switching and protecting a line even in an abnormal state such as a fault, a short circuit current, or the like.

The gas insulator switchgear may be configured with a circuit breaker, a disconnecting switch, a grounding switch, an instrument transformer, a lightning arrester, a busbar and the like in a sealed metal tank filled with insulating gas SF6.

Among the internal constituent elements of the gas insulator switchgear, a circuit breaker is a device capable of speedily and safely blocking a fault current to protect a system and various power devices when a failure occurs in the power system.

Here, allowing the circuit breaker to block a fault current denotes extinguishing an arc occurring between two contacts while blocking the fault current.

FIG. 1A is a schematic view illustrating the operation state of a puffer extinction type circuit breaker, and is a connected state between the breaker contacts, and FIG. 1B is a schematic view illustrating the operation state of a puffer extinction type circuit breaker and is a disconnected state between the breaker contacts.

In FIGS. 1A and 1B, the circuit breaker may include a stationary portion 20 and a movable portion 30 disposed to face each other in an axial direction in a tank 1 filled with an insulating gas.

Here, the movable portion 30 may be connected to an actuator 35 to be movable in an axial direction by the actuator 35.

The stationary portion 20 may be fixed to one side within the tank 10.

The stationary portion may include a stationary contactor 21 and a stationary arc contactor.

The stationary contactor 21 may be provided with a stationary main contact 21*a* and formed with a hollow pipe shape.

The stationary arc contactor 22 may be installed within the stationary contactor 21.

The stationary arc contactor 22 may be provided with a stationary arc contact 22*a* at a front end portion thereof.

The movable portion 30 may include a puffer cylinder 31, a moving main contact, a moving nozzle, and an operating rod.

The puffer cylinder 31 may have a compression chamber therewithin.

The moving main contact 32 and moving nozzle 33 may be disposed and assembled at an end portion of the puffer cylinder to be brought into contact with each other in an axial direction.

The moving main contact 32 and moving nozzle 33 may be disposed in a concentric manner.

The moving main contact 32 may be disposed outside.

The moving nozzle 33 may be disposed to be inserted into the moving main contact.

The operating rod 34 may include a moving arc contact 34*a* at a front end thereof.

The operating rod 34 may connect the moving main contact 32 to the actuator 35 such that the stationary arc contact 22*a* and moving arc contact 34*a* are brought into contact with or separated from each other.

Here, the moving main contact 32, moving nozzle 33 and puffer cylinder 31 in the movable portion 30 are conductive conductors through which a current flow.

The moving main contact 32 is disposed to be brought into contact with the inside of the stationary main contact 21*a* to flow a normal current during the contact.

The puffer cylinder 31 may be provided with a piston 36 fixed and provided therein.

The puffer cylinder 31 may be movable by the actuator 35.

When the puffer cylinder 31 is moved in a right direction (based on FIG. 1A) by the actuator 35, it may compress insulating gas within the compression chamber.

Here, the piston 36 may be fixed by a piston rod 37 fixed and provided at the other side within the tank 10.

The moving nozzle 33 may be connected to the compression chamber in a communication manner.

When the stationary arc contact 22*a* and moving arc contact 34*a* are separated from each other, the compressed insulating gas is injected through the moving nozzle 33 to extinguish an arc generated between the stationary arc contact 22*a* and moving arc contact 34*a*.

The arc extinction principle of a circuit breaker having the foregoing configuration will be described as follows.

As illustrated in FIG. 1A, the moving main contact 32 and moving arc contact 34*a* of the movable portion 30 are connected to the stationary main contact 21*a* and stationary arc contact 22*a* of the stationary portion 20, respectively, to flow a normal current while maintaining a state that each contact between the movable portion 30 and stationary portion 20 is connected to each other.

However, as illustrated in FIG. 1B, abnormality may occur in a power system.

In this case, when a fault current several times greater than the normal current flows, a driving coil of the actuator 35 is magnetized by the fault current, and the switch of the actuator 35 is operated by an electromagnetic force generated from the coil to move the movable portion 30 in a right direction.

Subsequently, as insulating gas filled in the compression chamber is compressed by the piston 36, and moved in a direction of being away from the stationary portion 20, the stationary arc contact 22*a* is separated from the moving arc contact 34*a*.

Subsequently, an arc is generated between the separated stationary arc contact 22*a* and moving arc contact 34*a*, and insulating gas compressed in the compression chamber of the puffer cylinder 31 is ejected between the moving nozzle 33 and moving arc contact 34*a*, and the arc is extinguished with the ejected insulating gas to block a fault current.

On the other hand, more specifically considering the assembly structure of the movable portion 30 provided within the circuit breaker with reference to FIG. 1A, the moving main contact 32 and moving nozzle 33 are fastened to an end portion of the puffer cylinder 31 by bolts 38*a*, 38*b*, respectively.

Here, the moving main contact 32 is brought into contact with an end portion of the puffer cylinder 31 on a first joint surface 31*a*, and the moving nozzle 33 is brought into contact with an end portion of the puffer cylinder 31 on a second joint surface 31*b*.

At this time, the first joint surface 31*a* and second joint surface 31*b* are located on the same vertical surface but the first joint surface 31*a* is located at the outside and the second joint surface 31*b* at the inside in a radial direction.

The first joint surface 31*a* and second joint surface 31*b* of the puffer cylinder 31 are a conductive contactsurface for flowing a current, and thus required to secure a large conductive area to the maximum extent on the first joint surface 31*a* and second joint surface 31*b*.

The area of the joint surface 31*a*, second joint surface 31*b* should be increased to secure the largest conductive area of the first joint surface 31*a* and second joint surface 31*b* to the maximum extent.

However, in a circuit breaker in the related art, since the diameter of the puffer cylinder 31 is increased as increasing the area of the joint surface 31*a*, 31*b*, the volume of the puffer cylinder 31 is increased.

Furthermore, there is a problem in which the fabrication cost of the puffer cylinder 31 and the energy of the actuator 35 for moving the movable portion 30 are increased.

Furthermore, FIG. 2 is an enlarged cross-sectional view illustrating a movable portion in a circuit breaker according to another embodiment of the related art, wherein an end portion (a right end portion based on FIG. 2) of the puffer cylinder 41 and a moving main contact 42 may be combined and brought into contact with each other by a first bolt 44*a* on the first joint surface 41*a*.

A coupling portion may be protruded and formed on an end portion (a left end portion based on FIG. 2) of the moving nozzle 43.

The coupling portion may be inserted and combined with an insertion groove formed between the moving main contact 42 and an end portion of the puffer cylinder 41.

A coupling protrusion to be protruded within the puffer cylinder 41 may be fastened to one surface of the coupling portion by a second bolt 44*b*.

In addition, the moving main contact 42 may be coupled to the other surface of the coupling portion on a third joint surface 44*c*.

Here, the moving nozzle 43 receives a force in the direction of the coupling portion 43*a* (in a right direction on the drawing) from the puffer cylinder 41 by the second bolt 44*b* fastened to the second joint surface 41*b*, and receives a force in the direction of the coupling portion 43*a* (in a left direction on the drawing) from the moving main contact 42 by the first bolt 44*a* fastened to the first joint surface 41*a*.

However, three joint surfaces 41*a*, 41*b*, 41*c* exist between the puffer cylinder 41, moving nozzle 43 and moving main contact 42, and those joint surfaces 41*a*, 41*b*, 41*c* should be located at the upper and lower portions thereof, respectively, based on FIG. 2 to secure machining accuracy on six joint surfaces during the part machining process, thereby making machining difficult and increasing cost.

Furthermore, the first joint surface 41*a* between the puffer cylinder 41 and moving main contact 42 should preferentially secure assembly dimensions than those of the second joint surface 41*b* between the puffer cylinder 41 and the coupling portion 43*a* of the moving nozzle 43, and the third joint surface 41*c* between the moving main contact 42 and the coupling portion 43*a* of the moving nozzle 43.

It is because the puffer cylinder 41 and the coupling portion 43*a* of the moving nozzle 43 are not matched to each other when assembly dimensions are inaccurate on the first joint surface 41*a* between the puffer cylinder 41 and moving main contact 42, thereby disabling the assembly.

Furthermore, when the assembly dimensions of the first joint surface 41*a* are not matched to each other, it may cause a problem in securing the conductivity of the circuit breaker as a conductive contactsurface.

SUMMARY OF THE INVENTION

The present disclosure is contrived to solve the foregoing problems, and a first technical task of the present disclosure is to provide a circuit breaker having a compact contact assembly structure capable of securing conductive capability without increasing the diameter of the puffer cylinder.

Furthermore, a second technical task of the present disclosure is to provide a circuit breaker having a compact contact assembly structure capable of reducing the number of contactsurfaces being brought into contact with each other during the assembly of the moving main contact and moving nozzle onto the puffer cylinder, thereby securing machining cost reduction and assembly accuracy.

In order to accomplish the foregoing first technical task, according to an aspect of the present disclosure, there is provided a circuit breaker including a tank, a stationary portion, and a movable portion.

The tank may be an enclosure of the circuit breaker.

The stationary portion may be provided at one side within the tank.

The movable portion may be provided at the other side within the tank to move while facing the stationary portion.

The movable portion may conduct or block a current through the operation of being brought into contact with or separated from the stationary portion.

The movable portion may include a puffer cylinder, a moving main contact, and a moving nozzle.

The puffer cylinder may temporarily store a compressible fluid.

The moving main contact may be assembled to an end of the puffer cylinder.

The moving main contact may include an accommodation space therein.

The moving nozzle may be inserted into the moving main contact.

The moving main contact may include a plurality of internal protrusions.

The internal protrusion may be protruded in a radial direction and separated in a circumferential direction from an inner surface thereof.

The moving nozzle may include a plurality of external protrusions.

The external protrusion may be protruded in a radial direction on an external surface thereof.

The external protrusion may be disposed to be separated in a circumferential direction.

The internal and external protrusions may be alternately disposed to each other along the circumferential direction.

The internal and external protrusions may be coupled to the puffer cylinder, respectively, by a fastening member.

According to the foregoing aspect of the present disclosure, the moving main contact and moving nozzle may be brought into contact with the puffer cylinder to be assembled thereto at the same time.

According to the foregoing aspect of the present disclosure, the internal protrusions of the moving main contact and the external protrusions of the moving nozzle may be separated from the same central point with a uniform radius with respect to the puffer cylinder and alternately disposed to each other along a circumferential direction, thereby increasing the conductive area of the moving main contact and moving nozzle without increasing the diameter of the puffer cylinder so as to secure a conductive capability. As a result, it may be possible to accomplish the first technical task.

Furthermore, according to the foregoing aspect of the present disclosure, the internal protrusions of the moving main contact and the external protrusions of the moving nozzle may be selectively brought into contact with the puffer cylinder on the cross section in the same diametric direction, thereby drastically reducing the number of joint surfaces brought into contact with the puffer cylinder during the assembly of the moving main contact and moving nozzle compared to the related art as well as enhancing machining cost reduction and assembly accuracy. As a result, it may be possible to accomplish the second technical task.

According to an aspect of the present disclosure, each of the external protrusions may be inserted between the adjoining internal protrusions, respectively.

The internal protrusion may include a fastening groove therein, and the external protrusion may include a fastening hole therein, and the internal and external protrusions may be assembled to the puffer cylinder, respectively, by main contact assembly bolts and nozzle assembly bolts alternately disposed along a circumferential direction.

The internal and external protrusions may include fastening holes, respectively, and the internal and external protrusions may be assembled to the puffer cylinder, respectively, by main contact assembly bolts and nozzle assembly bolts, and nuts alternately disposed along a circumferential direction.

The puffer cylinder may include a coupling portion protruded in an inner radial direction and extended along a circumferential direction at an end portion thereof.

The internal and external protrusions may be disposed to be surface-contact with one surface of the coupling portion at the same time and fastened by the fastening member.

The minimum diameter of the internal protrusion may be less than the maximum diameter of the external protrusion.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 4 is viewed from the axial direction;

DETAILED DESCRIPTION OF THE INVENTION

Hereinafter, a preferred embodiment of the present disclosure will be described in detail with reference to the accompanying drawings to such an extent that the present disclosure can be easily implemented by a person having ordinary skill in the art to which the present disclosure pertains.

Figure 1A:
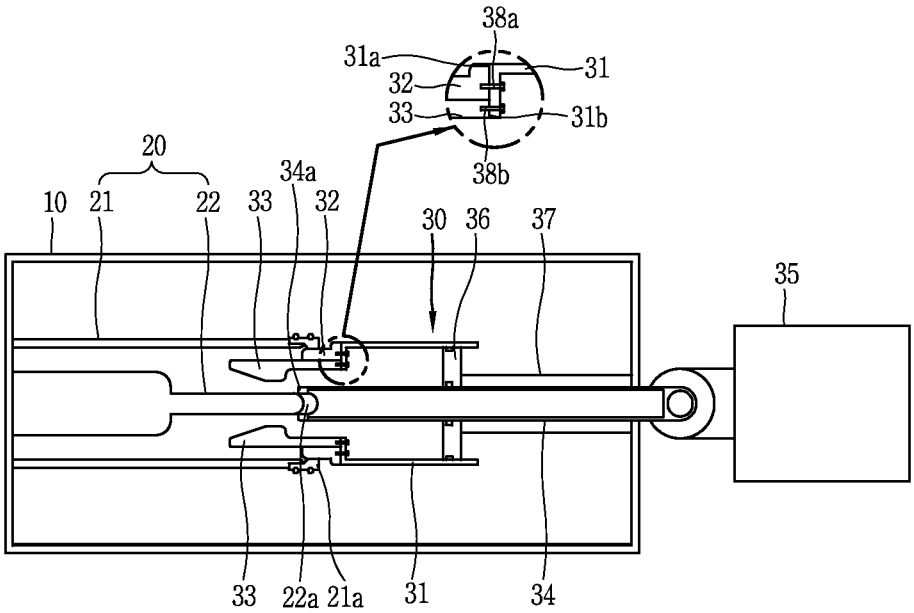
FIG. 1A PRIOR ART
FIG. 1A is a schematic view illustrating the operation state of a puffer extinction type circuit breaker, and is a connected state between the breaker contacts.
Figure 1B:
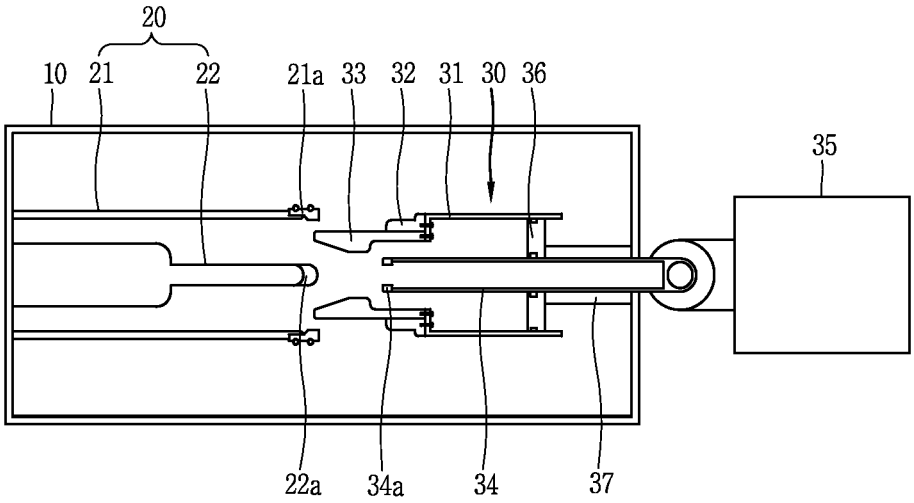
FIG. 1B PRIOR ART
FIG. 1B is a schematic view illustrating the operation state of a puffer extinction type circuit breaker and is a disconnected state between the breaker contacts.
Figure 2:
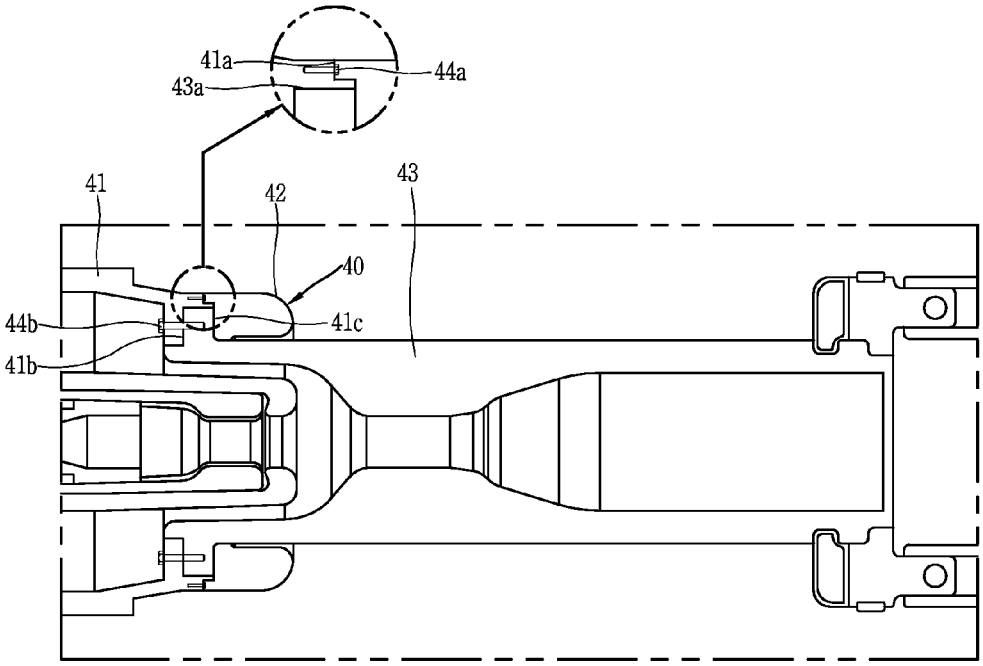
FIG. 2 PRIOR ART
FIG. 2 is an enlarged cross-sectional view illustrating a movable portion in a circuit breaker according to anther embodiment of the related art.
Figure 3:
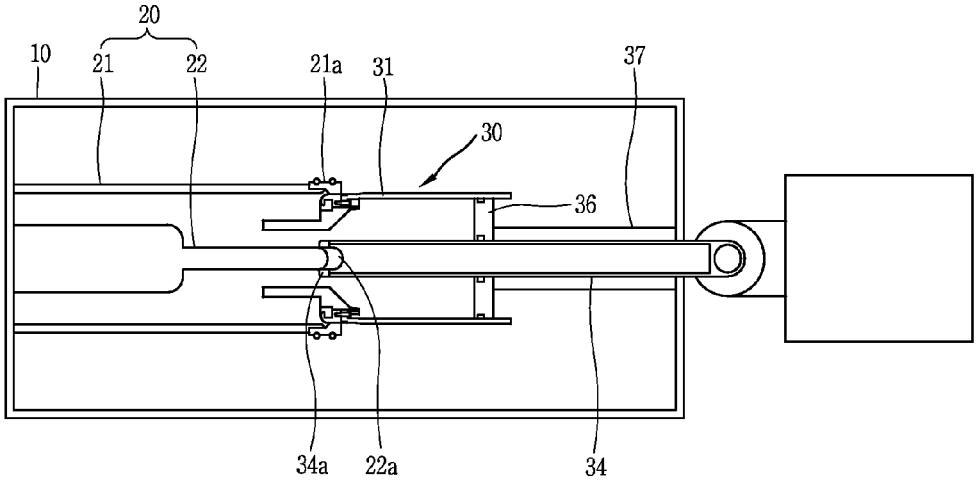
FIG. 3 is a schematic view illustrating the internal structure of a circuit breaker according to the present disclosure.

FIG. 3 attached herewith is a schematic view illustrating the internal structure of a circuit breaker according to the present disclosure.

The present disclosure relates to a circuit breaker having a compact contact assembly structure.

As illustrated in FIG. 3, a circuit breaker according to the present disclosure may largely include a tank 10, a stationary portion 20 and a movable portion 30.

The tank 10 is formed with an accommodation space therein to accommodate and protect the stationary portion 20 and movable portion 30 within the tank 10.

The stationary portion 20 is fixed and provided at one side (left side based on the drawing) within the tank 10.

The stationary portion 20 may include a stationary contactor 21 and a stationary arc contactor 22.

The stationary contactor 21 is configured with a pipe structure having an accommodation space therein, and a ring shaped stationary main contact 21*a* is formed at a front end portion of the stationary contactor 21.

The stationary arc contactor 22 may be configured with a rod structure formed to be elongated in an axial direction at an inner central portion of the stationary contactor 21, and a stationary arc contact (22*a*) is formed at a front end portion of the stationary arc contactor 22.

The movable portion 30 is provided to move at the other side within the tank 10.

The movable portion 30 may include a puffer cylinder 31 provided with a compression chamber therein to temporarily store insulating gas, a moving main contact 32 assembled and integrated into the puffer cylinder 31 to be operable, a moving nozzle 33 inserted into the moving main contact 32, and an operating rod 34 coupled to the puffer cylinder 31 within the piston load 37.

An end portion of the operating rod 34 is connected to the actuator 35 through the medium of the connecting rod to be driven in an axial direction, wherein the actuator 35 is configured with any one selected from a pneumatic or hydraulic cylinder mechanism and a motor to drive the operating rod 34.

The puffer cylinder 31 may include a piston 36 fixed and provided therein, and the piston 36 is fixed and supported by the piston load 37 fixed and provided at the other end portion within the tank 10.

Here, when the puffer cylinder 31 is moved in a right-hand axial direction by the actuator 35, insulating gas temporarily stored within the puffer cylinder 31 is compressed by the piston 36.

When a ring shaped moving arc contact 34*a* is formed at a front end portion of the operating rod 34, and a rod shaped stationary arc contact 22*a* is inserted and brought into contact with the moving arc contact 34*a*, a closed state is maintained to flow a normal current.

However, when a fault current occurs in a power system, the actuator 35 is operated, and the operating rod 34 connected to the actuator 35 is moved in a right-hand axial direction, and an arc is generated while the moving arc contact 34*a* is separated from the stationary arc contact 22*a*, and the compressed insulating gas is blown from the puffer cylinder 31 to extinguish the arc, thereby blocking the fault current.

Here, a circuit breaker according to the present disclosure may share the assembly space of the moving main contact 32 and moving nozzle 33 on the same assembly surface 311*a*, thereby providing the assembly structure of the movable portion 30 capable of securing conductive capability and machining accuracy and minimizing a conductive area between the moving main contact 32, moving nozzle 33 and puffer cylinder 31, which are conductive conductors.

Figure 4:
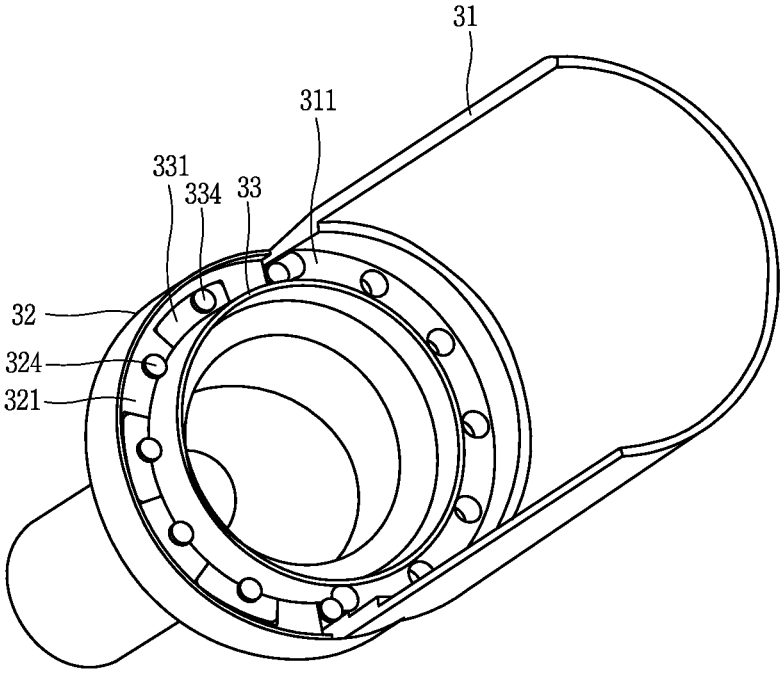
FIG. 4 is a perspective view illustrating the assembly structure of a movable portion which is a main part of the present disclosure.
Figure 5A:
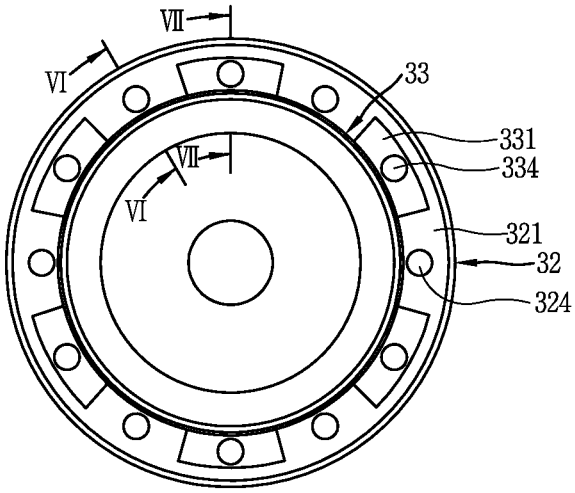
FIG. 5A is a side view illustrating a moving nozzle and a moving contact.
Figure 5B:
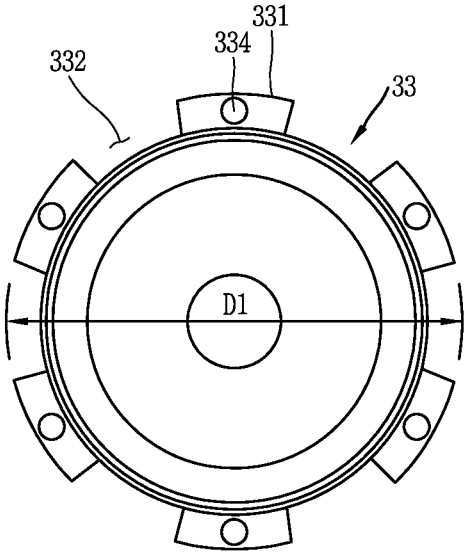
FIG. 5B is a side view illustrating a moving nozzle and FIG. 5C is a side view illustrating a moving main contact, when
Figure 5C:
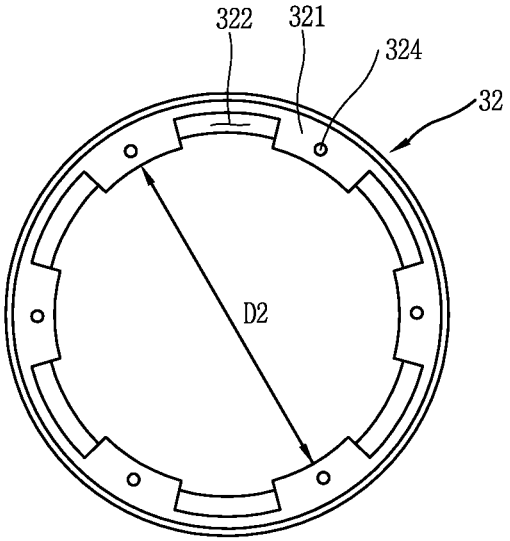
Figure 6:
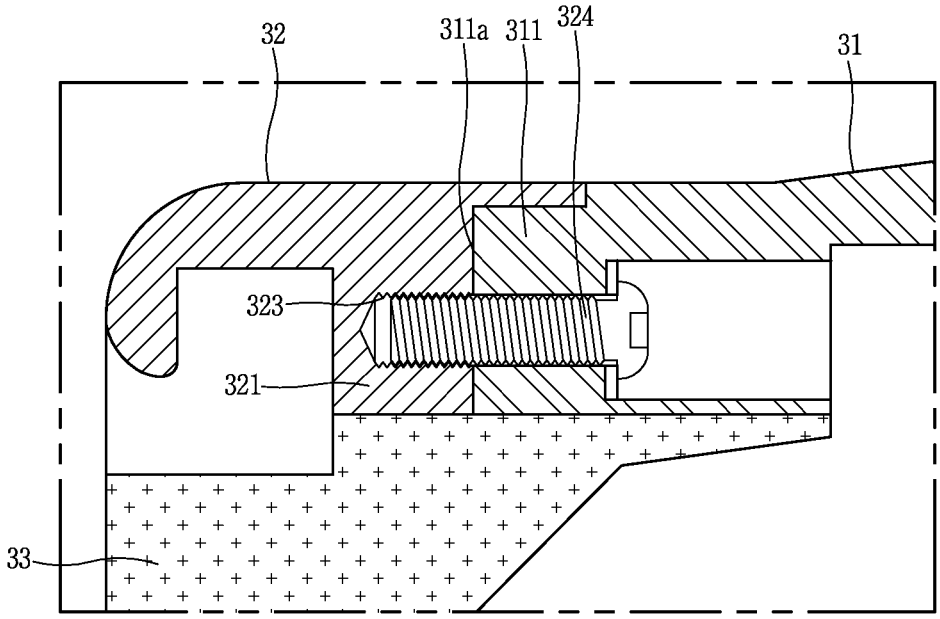
FIG. 6 is a cross-sectional view taken along line VI-VI in FIG. 5A.
Figure 7:
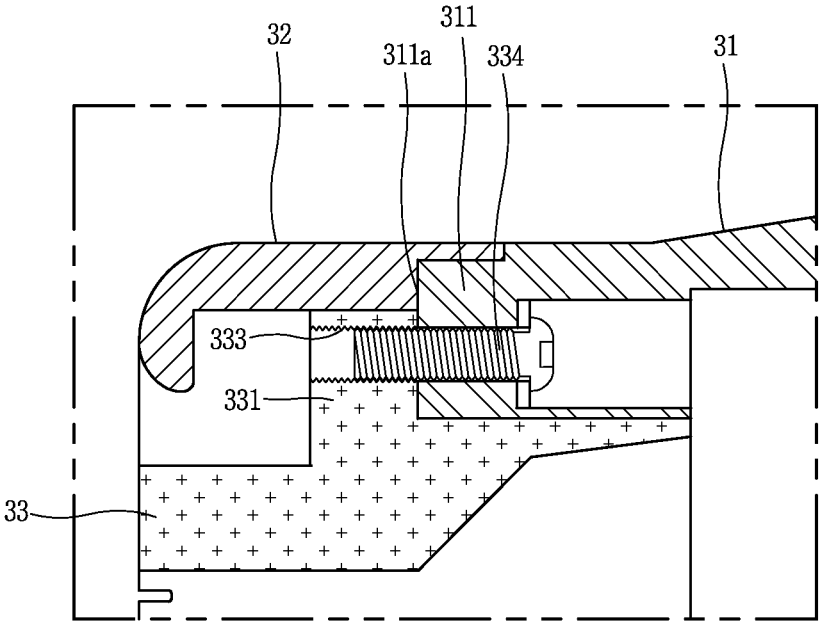
FIG. 7 is a cross-sectional view taken along line VII-VII in FIG. 5A.

FIG. 4 attached herewith is a perspective view illustrating the assembly structure of a movable portion which is a main part of the present disclosure, and FIG. 5A is a side view illustrating a moving nozzle and a moving contact, FIG. 5B is a side view illustrating a moving nozzle and FIG. 5C is a side view illustrating a moving main contact, when FIG. 4 is viewed from the axial direction, and FIG. 6 is a cross-sectional view taken along line VI-VI in FIG. 5A, and FIG. 7 is a cross-sectional view taken along line VII-VII in FIG. 5A.

The moving main contact 32 may include a ring shaped hollow hole therein, and the moving main contact 32 is inserted and brought into contact with the inside of the stationary main contact 21*a* to maintain a connecting state between the stationary main contact 21*a* and moving main contact 32.

Furthermore, a plurality of internal protrusions 321 are formed on an inner surface of the moving main contact 32 to be separated from each other at regular intervals along the circumferential direction while being protruded in a radial direction, wherein an external protrusion accommodation groove 322 is formed between the adjoining internal protrusions 321.

In addition, a hook portion is formed at an end portion of the moving main contact 32 to be bent in a radial direction, and an accommodation groove is subsequently formed at the other end portion of the moving main contact 32 along a circumferential direction, and thus an end portion (a left end portion based on FIG. 6) of the puffer cylinder 31 is inserted into the accommodation groove.

The moving nozzle 33 may include an expansion portion formed in a cylindrical shape, and formed at the middle in a length direction with a large diameter along the right-hand axial direction, and a shaft portion formed with a small diameter along the left-hand axial direction.

Here, the expansion portion is communicated with the compression chamber of the puffer cylinder 31, and the compressed insulating gas is inhaled from the puffer cylinder 31 to the expansion portion and exhausted through the shaft portion, thereby extinguishing an arc generated between the moving arc contact 34*a* and stationary arc contact 22*a*.

Furthermore, a plurality of external protrusions 331 are formed on an outer surface of the moving nozzle 33 to be separated from each other at regular intervals along the circumferential direction while being protruded in a radial direction, wherein an internal protrusion accommodation groove 332 is formed between the adjoining external protrusions 331.

Here, when the moving nozzle 33 is inserted into the moving main contact 32, the internal protrusions 321 are inserted into the internal protrusion accommodation groove 332 of the adjoining external protrusions 331, respectively, in an axial direction in a state that the external protrusions 331 of the moving nozzle 33 are disposed to be twisted at a predetermined angle along a circumferential direction with respect to the internal protrusions 321 of the moving main contact 32, and each of the external protrusions 331 is inserted into the internal protrusion accommodation groove 332 of the adjoining internal protrusions 321, respectively, in an axial direction, and thus the internal protrusions 321 and external protrusions 331 are alternately disposed to each other along the circumferential direction and brought into contact with an end portion of the puffer cylinder 31 at the same time and fastened by a fastening member, respectively.

In addition, main contact assembly bolts 324 and nozzle assembly bolts 334 disposed to be separated from each other along the inner circumferential direction at an end portion of the puffer cylinder 31 are provided as a fastening member for fastening the internal protrusions 321 to the external protrusions 331.

A coupling portion 311 is subsequently formed at an end portion of the puffer cylinder 31 along a circumferential direction while being protruded in a radial direction, and a plurality of through holes are formed on the coupling portion 311 at regular intervals along the circumferential direction.

In addition, fastening grooves 323 are formed at the inside of the internal protrusions 321, respectively, and fastening holes 333 are formed at the inside of the external protrusions 331, respectively, and as illustrated in FIGS. 6 and 7, bolt assembly female screw threads are formed on the fastening grooves 323 and fastening holes 333, respectively.

Here, the fastening groove 323 denotes a portion concavely formed up to a predetermined depth without being penetrated in an axial direction from the internal protrusion 321, and the fastening hole 333 denotes a portion penetrated in an axial direction from the external protrusion 331.

The main contact assembly bolt 324 is fastened to the fastening groove 323 of the internal protrusion 321 through the coupling portion 311 of the puffer cylinder 31, and the nozzle assembly bolt 334 is fastened to the fastening hole 333 of the external protrusion 331 through the coupling portion 311 of the puffer cylinder 31, thereby allowing the internal protrusions 321 and external protrusions 331 to be alternately disposed to each other along the circumferential direction and fastened on one surface 311*a* of the coupling portion 311 of the puffer cylinder 31 at the same time.

Here, it has been described that the fastening grooves 323 and fastening holes 333 are formed on the internal protrusions 321 and external protrusions 331, respectively, but on the contrary, the fastening groove may be formed on the external protrusion and the fastening hole on the internal protrusion, or the fastening holes may be formed on the internal and external protrusions, respectively.

Figure 8:
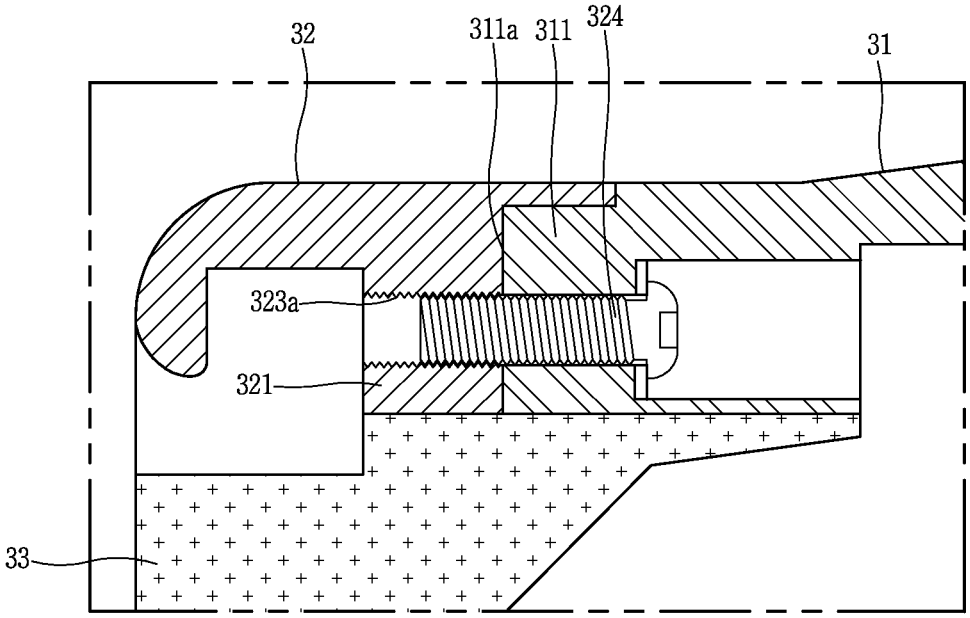
FIG. 8 is an exemplary cross-sectional view illustrating the fastening structure of an internal protrusion according to another embodiment of the present disclosure.

For example, FIG. 8 is an exemplary cross-sectional view illustrating the fastening structure of an internal protrusion according to another embodiment of the present disclosure, in which a fastening hole 323*a* having female screw threads is formed within the internal protrusion 321, and the main contact assembly bolt 324 is fastened to the fastening hole 323*a* of the internal protrusion 321 through a through hole formed at a coupling portion of the puffer cylinder 31.

Figure 9:
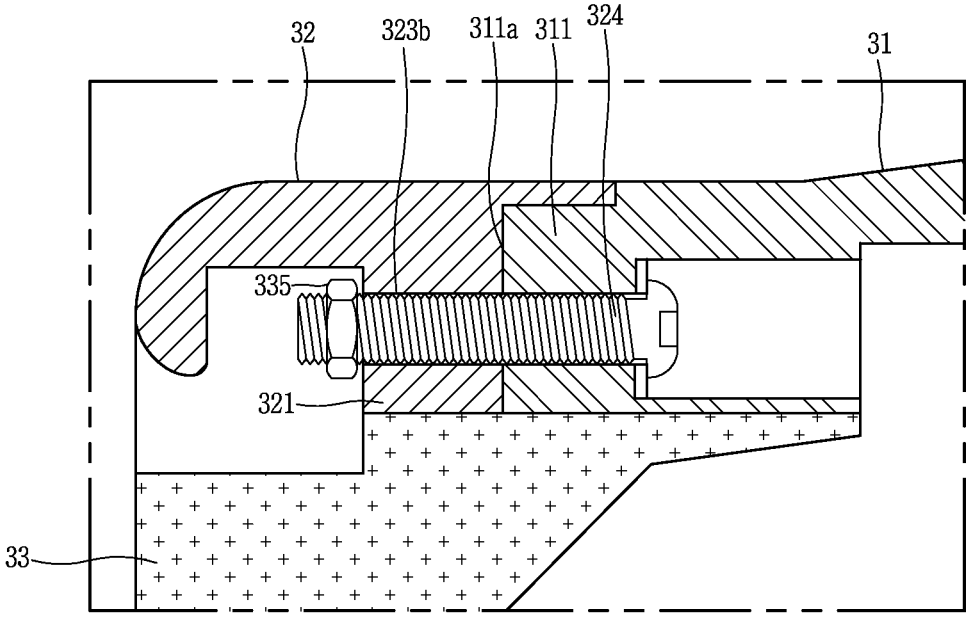
FIG. 9 is an exemplary cross-sectional view illustrating the fastening structure of an internal protrusion according to still another embodiment of the present disclosure.

Furthermore, FIG. 9 is an exemplary cross-sectional view illustrating the fastening structure of an internal protrusion according to still another embodiment of the present disclosure, in which a fastening hole 323*b* with no female screw threads is formed within the internal protrusion 321, and a nut 335 is provided on one surface of the internal protrusion 321, and a main contact assembly bolt 334 is fastened through a through hole formed on the coupling portion 311 of the puffer cylinder 31 and the fastening hole 323*b* of the internal protrusion 321 by the nut 335.

In this manner, the internal protrusions 321 and external protrusions 331 are alternately disposed along the circumferential direction while maintaining the same radius, the moving main contact 32 and moving nozzle 33 are fastened to one surface 311*a* of the coupling portion 311 of the puffer cylinder 31, respectively, to share an assembly space in a radial direction, thereby implementing a compact assembly structure.

In addition, a washer is fastened between the coupling portion 311 and bolts 324, 334 to securely maintain a fastening force.

The internal protrusions 321 and external protrusions 331 may be configured with any one selected from a rectangular shape, a fan shape, a trapezoidal shape, a semicircular shape, and a sawtooth shape.

Furthermore, it is described on the drawing according to an embodiment of the present disclosure that the numbers of external protrusions 331 and 321 correspond to each other one-to-one, and the intervals of the internal protrusion accommodation groove 332 and external protrusion accommodation groove 322 correspond to each other at regular intervals, and the external protrusions 331 are inserted into the external protrusion accommodation groove 322 between the adjoining internal protrusions 321 and thus the internal protrusions 321 and external protrusions 331 are alternately disposed to each other along the circumferential direction.

However, it will be apparent to those skilled in this art that the number of the internal protrusions 321 and external protrusions 331 and the intervals of the accommodation grooves 322, 332 formed between the adjoining internal protrusions 321 and external protrusions 331 can be changed in various ways.

When the numbers of the internal protrusions 321 and external protrusions 331 are different, for example, two internal protrusions 321 may be inserted into the internal protrusion accommodation groove 332 since the number of the internal protrusions 321 is greater than that of the external protrusions 331 by one and the interval of the internal protrusion accommodation groove 332 is wider than that of the external protrusion accommodation groove 322, and on the contrary, two external protrusions 331 may be inserted into the external protrusion accommodation groove 322 since the number of external protrusions 331 is greater than that of the internal protrusions 321 by one and the interval of the external protrusion accommodation groove 322 is wider than that of the internal protrusion accommodation groove 332.

Otherwise, the numbers of the internal protrusions 321 and external protrusions 331 are the same, but two internal protrusions 321 and two external protrusions 331 may be inserted into the internal protrusion accommodation groove 332 and external protrusion accommodation groove 322.

Consequently, according to the present disclosure, the moving main contact 32 and moving nozzle 33 may be alternately disposed to each other along the circumferential direction during the assembly of the movable portion 30 which is a constituent element of the circuit breaker to be fastened to one surface 311*a* of the coupling portion 311 of the puffer cylinder 31, respectively, to increase an area of the contact-surface being brought into contact with the puffer cylinder 31 without increasing the diameter of the puffer cylinder 31, thereby securing conductive capability between the moving main contact 32 and moving nozzle 33.

Furthermore, the moving main contact 32 and moving nozzle 33 may be alternately disposed to each other along the circumferential direction to minimize the number of contact-surfaces brought into contact with during the assembly of the puffer cylinder 31, moving main contact 32 and moving nozzle 33, thereby enhancing machining cost and assembly accuracy.

Although the preferred embodiments of the present invention have been described in detail, the rights scope of the present invention is not limited to the embodiments and various modifications and improvements thereto made by those skilled in the art using the basic concept of the present invention as defined in the accompanying claims will fall in the rights scope of the invention.

What is claimed is:

1. A circuit breaker, comprising:

a tank;

a stationary portion provided at one side within the tank; and a movable portion provided at the other side within the tank to move while facing the stationary portion so as to conduct or block a current through the operation of being brought into contact with or separated from the stationary portion, wherein the movable portion comprises:

a puffer cylinder configured to temporarily store a compressible fluid;

a moving main contact assembled to an end of the puffer cylinder to have an accommodation space in the moving main contact; and a moving nozzle inserted into the moving main contact, and wherein the moving main contact comprises a plurality of internal protrusions protruded in a radial direction and separated in a circumferential direction from an inner surface of the moving main contact, and the moving nozzle comprises a plurality of external protrusions protruded in a radial direction and separated in a circumferential direction on an external surface of moving nozzle, and wherein the internal and external protrusions are alternately disposed to each other along the circumferential direction, and the internal and external protrusions are coupled to the puffer cylinder, respectively, by a fastening member.

2. The circuit breaker of claim 1, wherein each of the external protrusions is inserted between the adjoining internal protrusions, respectively.

3. The circuit breaker of claim 1, wherein the internal protrusion comprises a fastening groove in the internal protrusion, and the external protrusion comprises a fastening hole in the external protrusion, and the internal and external protrusions are assembled to the puffer cylinder, respectively, by main contact assembly bolts and nozzle assembly bolts alternately disposed along a circumferential direction.

4. The circuit breaker of claim 1, wherein the internal and external protrusions comprise fastening holes, respectively, and the internal and external protrusions are assembled to the puffer cylinder, respectively, by main contact assembly bolts and nozzle assembly bolts, and nuts alternately disposed along a circumferential direction and nuts corresponding to the main contact assembly bolts and nozzle assembly bolts.

5. The circuit breaker of claim 1, wherein the puffer cylinder comprises a coupling portion protruded in an inner radial direction at an end portion thereof, and the internal and external protrusions are disposed to be put in face to face contact with one surface of the coupling portion at the same time and fastened by the fastening member.

6. The circuit breaker of claim 1, wherein the minimum diameter of the internal protrusion is less than the maximum diameter of the external protrusion.

* * * * *